US006657592B2

(12) United States Patent
Dening et al.

(10) Patent No.: US 6,657,592 B2
(45) Date of Patent: Dec. 2, 2003

(54) PATCH ANTENNA

(75) Inventors: David Dening, Stokesdale, NC (US); Vic Steel, Oak Ridge, NC (US); Leonard Reynolds, Chapel Hill, NC (US)

(73) Assignee: RF Micro Devices, Inc., Greensboro, NC (US)

( * ) Notice: Subject to any disclaimer, the term of this patent is extended or adjusted under 35 U.S.C. 154(b) by 0 days.

(21) Appl. No.: 10/133,794

(22) Filed: Apr. 26, 2002

(65) Prior Publication Data

US 2003/0201938 A1 Oct. 30, 2003

(51) Int. Cl.[7] ..... H01Q 1/38

(52) U.S. Cl. ..... 343/700 MS; 343/848; 343/893

(58) Field of Search ..... 343/700 MS, 702, 343/829, 846, 853, 893, 848

(56) References Cited

U.S. PATENT DOCUMENTS 6,166,705 A * 12/2000 Mast et al. ..... 343/853
6,262,495 B1 7/2001 Yablonovitch et al. ..... 307/101
6,300,907 B1 * 10/2001 Lazar et al. ..... 343/700 MS
6,426,722 B1 * 7/2002 Sievenpiper et al. . 343/700 MS
6,469,673 B2 * 10/2002 Kaiponen ..... 343/703
6,483,481 B1 * 11/2002 Sievenpiper et al. ..... 343/909
6,552,686 B2 * 4/2003 Ollikainen et al. .. 343/700 MS

OTHER PUBLICATIONS

Broas, Romulo F. Jimenez, Sievenpiper, Daniel F., and Yablonovitch, Eli, "A High–Impedence Ground Plane Applied to a Cellphone Handset Geometry," IEEE Transactions on Microwave Theory and Techniques, vol. 49, No. 7, Jul. 2001, pp. 1262–1265.

* cited by examiner

*Primary Examiner*—Tan Ho
*Assistant Examiner*—Shih-Chao Chen
(74) *Attorney, Agent, or Firm*—Withrow & Terranova, PLLC

(57) ABSTRACT

A patch antenna may be integrated into a mobile terminal by associating the patch antenna with a ground plane adapted to remove eddy currents and isolate the antenna from spurious electromagnetic signals. The patch antenna may comprise a kink. Together the patch antenna and ground plane form a surface on which other electrical components may be mounted, such as the transceiver circuitry of the mobile terminal.

20 Claims, 7 Drawing Sheets

PATCH ANTENNA

FIELD OF THE INVENTION

The present invention relates to an antenna for use in a mobile terminal and specifically to a patch antenna structure that serves a dual purpose within the mobile terminal.

BACKGROUND OF THE INVENTION

First there were pagers, then wireless phones, and more recently, personal digital assistants. Recent events have led to a convergence of these devices under the general appellation of a mobile terminal. Common to these devices in the latest generation is the ability to communicate wirelessly with a remote location.

These mobile terminals are becoming ubiquitous throughout the world. While telecommunication standards may vary from country to country, the wireless revolution is in full swing. Mobile terminals can now be seen almost everywhere, and are becoming the pervasive computing devices envisioned.

Since the initial car and bag phones were introduced, there has been constant pressure on the part of mobile terminal manufacturers to make the mobile terminals smaller. Keypads, batteries, and electrical components have all been reduced in size to make mobile terminals with smaller profiles.

One area that historically has been resistant to changes in size is the antenna of the mobile terminal. This has been due to the need to isolate the antenna from other sensitive electronic components within the mobile terminal from cross talk and other electromagnetic compatibility issues. For example, positioning an antenna close to the electronic components may cause spurious emissions exceeding allowable FCC standards.

A concurrent trend in the mobile terminal industry is to modularize components such that only a few modules contain all of the electrical components for the mobile terminal. Coupled with this modularization effort are efforts to integrate the electrical components into a single chip such that manufacturing costs are decreased.

Heretofore, efforts to remove the traditional stub antenna and integrate an antenna into the body of the mobile terminal have failed.

SUMMARY OF THE INVENTION

The present invention enables an antenna to be integrated within the body of a mobile terminal. Specifically, the present invention takes advantage of a ground plane structure that dissipates eddy currents and isolates a patch antenna from spurious electromagnetic signals. This structure then forms a substrate for other electrical components, such as those that comprise a transceiver front end for the mobile terminal.

In one embodiment, the antennas include a kink to increase the electrical length thereof and to perform impedance matching.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
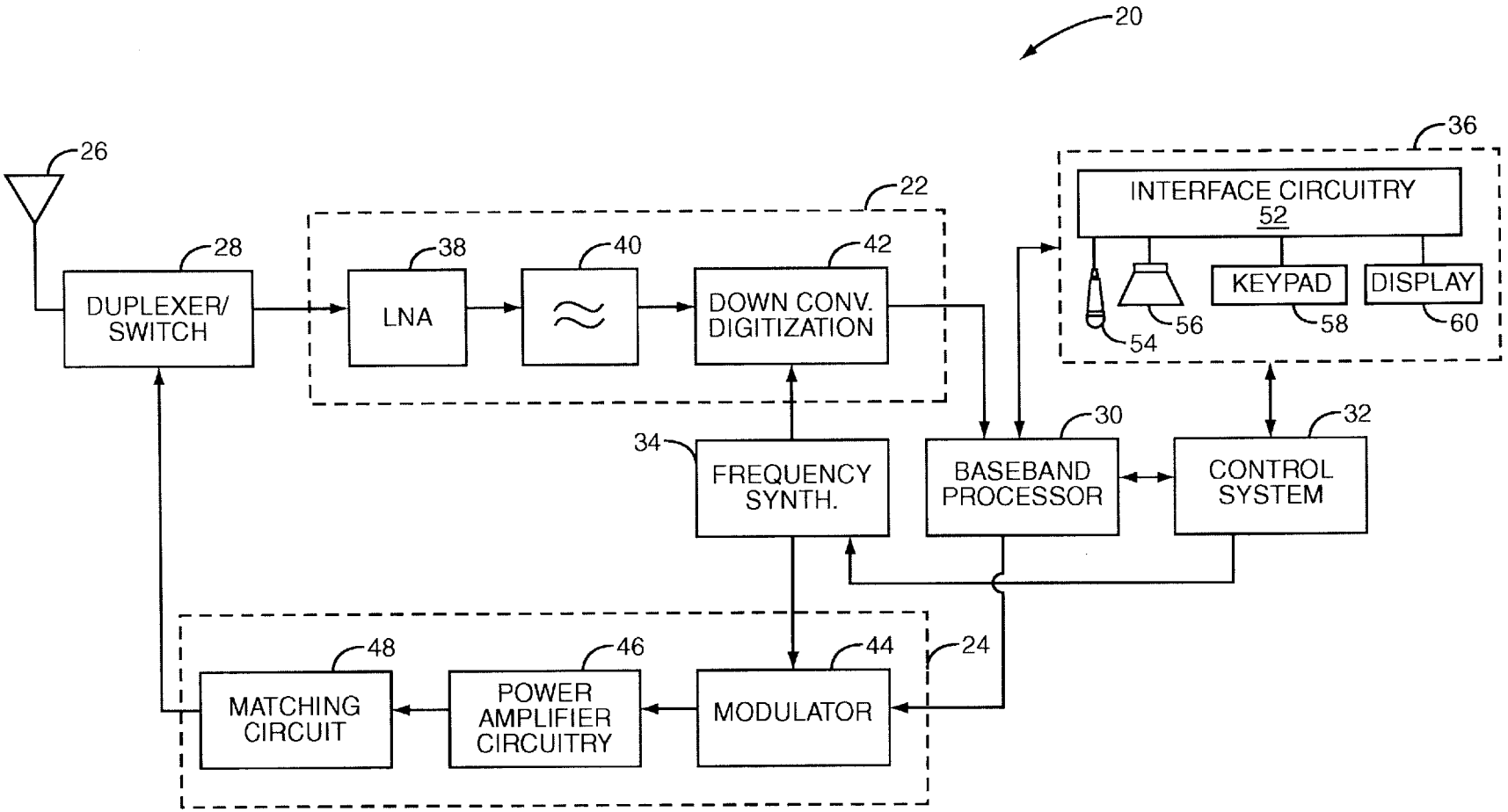
FIG. 1 illustrates a schematic drawing of a mobile terminal such as may be used with the present invention.

The present invention is preferably incorporated in a mobile terminal 20, such as a cellular telephone, personal digital assistant, or the like. The basic architecture of a mobile terminal 20 is represented in FIG. 1 and may include a receiver front end 22, a radio frequency transmitter section 24, an antenna 26, a duplexer or switch 28, a baseband processor 30, a control system 32, a frequency synthesizer 34, and an interface 36. The receiver front end 22 receives information bearing radio frequency signals from one or more remote transmitters provided by a base station. A low noise amplifier 38 amplifies the signal. A filter circuit 40 minimizes broadband interference in the received signal, while downconversion and digitization circuitry 42 downconverts the filtered, received signal to an intermediate or baseband frequency signal, which is then digitized into one or more digital streams. The receiver front end 22 typically uses one or more mixing frequencies generated by the frequency synthesizer 34.

The baseband processor 30 processes the digitized received signal to extract the information or data bits conveyed in the received signal. This processing typically comprises demodulation, decoding, and error correction operations. As such, the baseband processor 30 is generally implemented in one or more digital signal processors (DSPs).

On the transmit side, the baseband processor 30 receives digitized data, which may represent voice, data, or control information, from the control system 32, which it encodes for transmission. The encoded data is output to the radio frequency transmitter section 24, where it is used by a modulator 44 to modulate a carrier signal that is at a desired transmit frequency. Power amplifier circuitry 46 amplifies the modulated carrier signal to a level appropriate for transmission from the antenna 26.

The amplified signal is sent to the switch 28 and antenna 26 through an impedance matching circuit 48, which is configured to set the overall load impedance for the amplifier circuitry 46 to optimize values based on the type or speed of information being transmitted. Typically, the switch 28 and antenna 26 provide a relatively constant load impedance, which is combined with the impedance of the impedance matching circuit 48 to establish an overall load impedance for the amplifier circuitry 46.

Receiver front end 22, the radio frequency transmitter section 24, the frequency synthesizer 34, the baseband processor 30, and the control system 32 are sometimes referred to herein as the transceiver circuitry. Since the operation of this circuitry is well understood for those of ordinary skill in the art, any further discussion is omitted.

A user may interact with the mobile terminal 20 via the interface 36, which may include interface circuitry 52 associated with a microphone 54, a speaker 56, a keypad 58, and a display 60. The interface circuitry 52 typically includes analog-to-digital converters, digital-to-analog converters, amplifiers, and the like. Additionally, it may include a voice encoder/decoder, in which case it may communicate directly with the baseband processor 30.

The microphone 54 will typically convert audio input, such as the user's voice, into an electrical signal, which is then digitized and passed directly or indirectly to the baseband processor 30. Audio information encoded in the received signal is recovered by the baseband processor 30, and converted into an analog signal suitable for driving speaker 56 by the I/O and interface circuitry 52. The keypad 58 and display 60 enable the user to interact with the mobile terminal 20, such as inputting numbers to be dialed, address book information, or the like, as well as monitor call progress information.

Other conventional circuitry may be integrated into the mobile terminal 20 as is well understood. For example, a global positioning satellite (GPS) receiver may be integrated into the mobile terminal 20. A Bluetooth module may be integrated into the mobile terminal 20 along with other short-range communication circuits, such as an IR circuit. The mobile terminal 20 operates according to conventional telecommunications standards such as GSM, AMPS, D-AMPS, and other similar international telecommunications standards as needed or desired.

Figure 2:
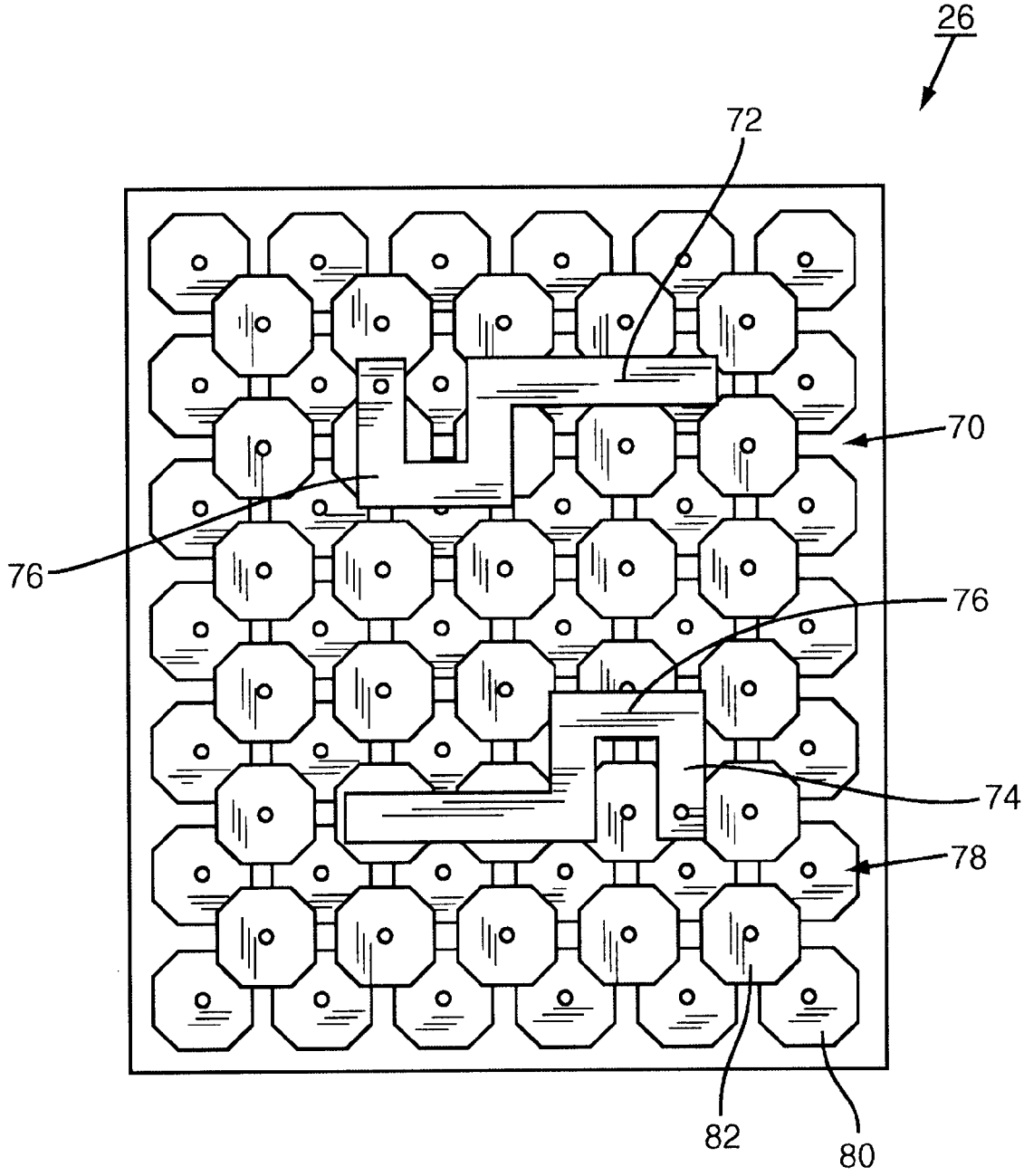
FIG. 2 illustrates a top plan view of an exemplary embodiment of the antenna of the present invention.

FIG. 2 illustrates one embodiment of the present invention wherein the antenna 26 is seen positioned over a substrate structure 70. In the embodiment shown, antenna 26 comprises a first radiating element 72 and a second radiating element 74. First and second radiating elements 72, 74 may be used together for diversity reception and transmission, or the first radiating element 72 may be used for transmission and the second radiating element 74 may be used for reception. Greater or lesser numbers of radiating elements may be used as needed or desired.

In the embodiment shown, the radiating elements 72, 74 each comprise a u-shaped kink 76 and are positioned over a first ground plane 78. The first ground plane 78 is comprised of two distinct levels of overlapping conductive plates 80, 82 (better seen in FIG. 3). For a full explanation of the first ground plane 78, reference is made to U.S. Pat. No. 6,262,495, which is hereby incorporated by reference in its entirety. The overlapping conductive plates 80, 82 are arranged in two distinct levels to reduce eddy currents within the first ground plane 78 and help provide directionality for the radiating elements 72, 74 as explained in the incorporated '495 patent.

The u-shaped kink 76 may be used to extend the electrical length of the radiating elements 72, 74, thereby effectively tuning the antenna 26. The kink 76 may also be used for impedance matching, or to provide dual band functionality for the antenna 26. The kink 76 adds inductive loading to the radiating elements 72, 74 while also increasing the capacitive coupling between the radiating elements 72, 74 and the first ground plane 78. Likewise, the kink 76 may be an electric short (i.e., the electromagnetic current on the radiating elements 72, 74 couples across the kink 76 rather than passing around the kink 76) at certain frequencies, thus creating a short antenna 26 at one frequency where the kink is shorted and a longer antenna 26 at other frequencies where the kink 76 is not bypassed. Geometries other than the kink 76 may be used as needed or desired.

Figure 3:
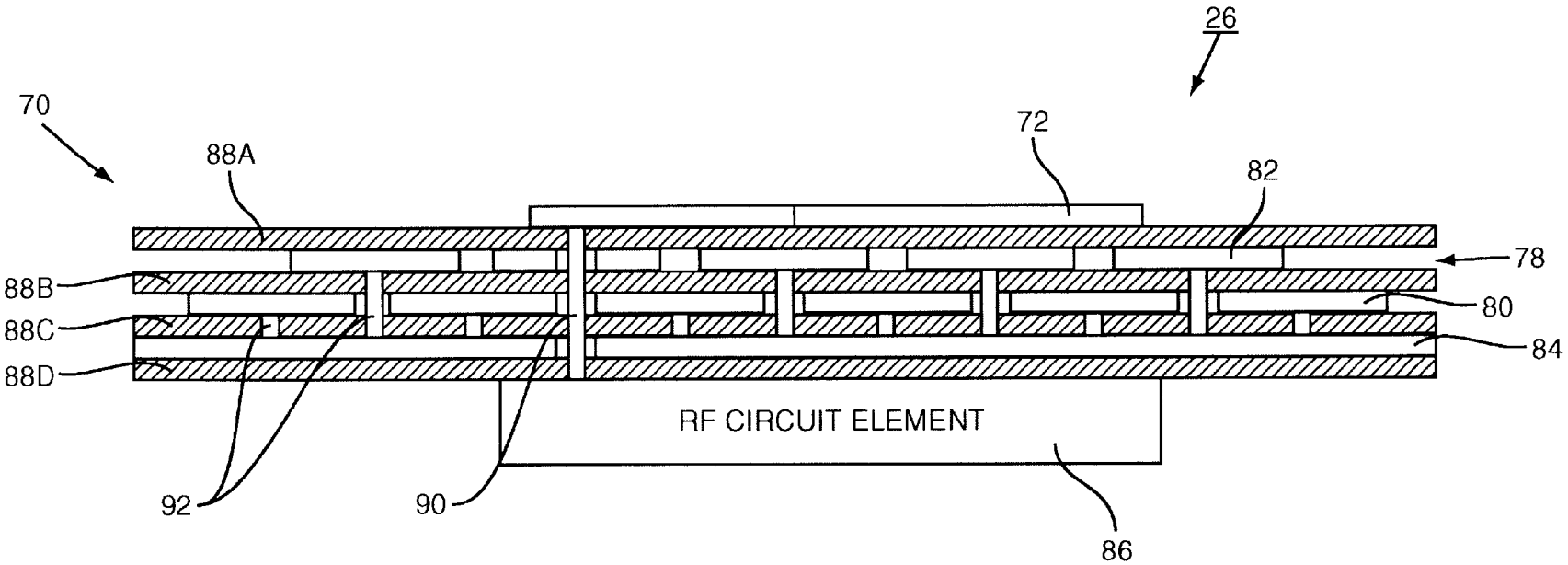
FIG. 3 illustrates a cross-sectional side view of the embodiment of FIG. 2.

The substrate structure 70 is also illustrated in FIG. 3, wherein the layered relationship of the various components is better illustrated. Specifically, the substrate structure 70 comprises the antenna 26, the first ground plane 78, a second ground plane 84, and an RF circuit element 86. Distinct plies 88 of dielectric material 88A, 88B, 88C, and 88D separate the various electric components. In an exemplary component, the plies 88 are formed from FR4. Other dielectric materials may also be used, and material type may vary between plies 88 if needed or desired.

The RF circuit element 86 may comprise as much of the transceiver circuitry as needed or desired. In an exemplary embodiment, the RF circuit element 86 comprises at least the duplexer 28, and may also comprise the radio frequency transmitter section 24 and the receiver front end 22. Still further, the frequency synthesizer 34 and baseband processor 30 may be considered an RF circuit element 86 for the purposes of the present invention. Preferably the RF circuit element 86 is printed or mounted on the ply 88D using conventional integrated circuit printing technology, or is mounted thereon using conventional fabrication techniques.

The antenna 26 may be electrically connected to the RF circuit element 86 using any appropriate electrical connections. In an exemplary embodiment, a through-hole via 90 is used to connect the antenna 26 to the RF circuit element 86. Other via connectors may also be used so long as the electrical connection therebetween is not shorted by inadvertent contact with either the first ground plane 78 or the second ground plane 84. The first ground plane 78 is electrically connected to the second ground plane 84 using via connectors 92 as is explained in the incorporated '495 patent.

The second ground plane 84 acts as a ground plane for any of the electronic components of the RF circuit element 86 as would be well understood. Thus, electrical connections may exist between RF circuit element 86 and the second ground plane 84 as needed or desired.

Figure 5:
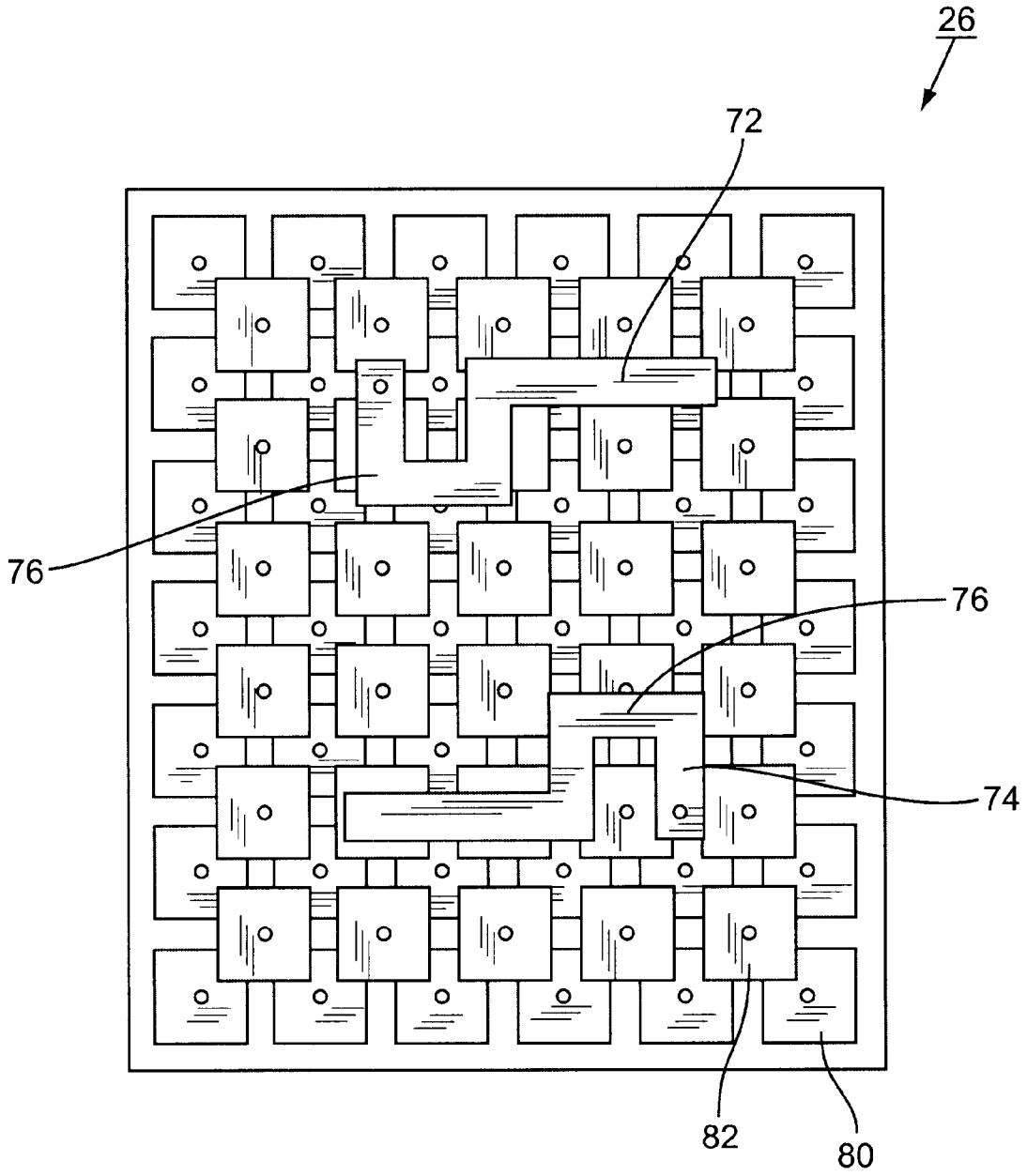
FIG. 5 illustrates an alternate embodiment with square overlapping plates.
Figure 6:
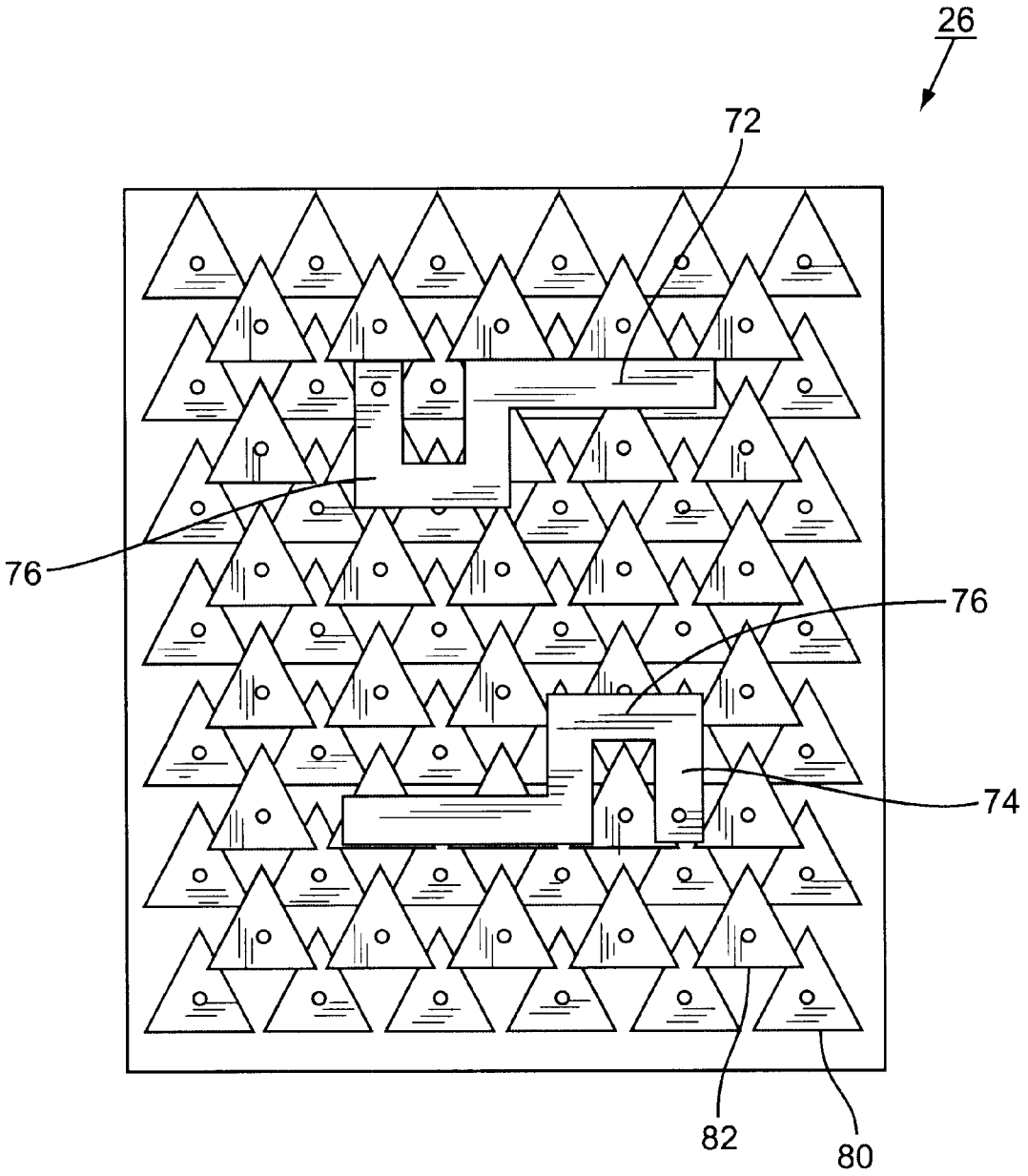
FIG. 6 illustrates another alternate embodiment with triangular overlapping plates.
Figure 7:
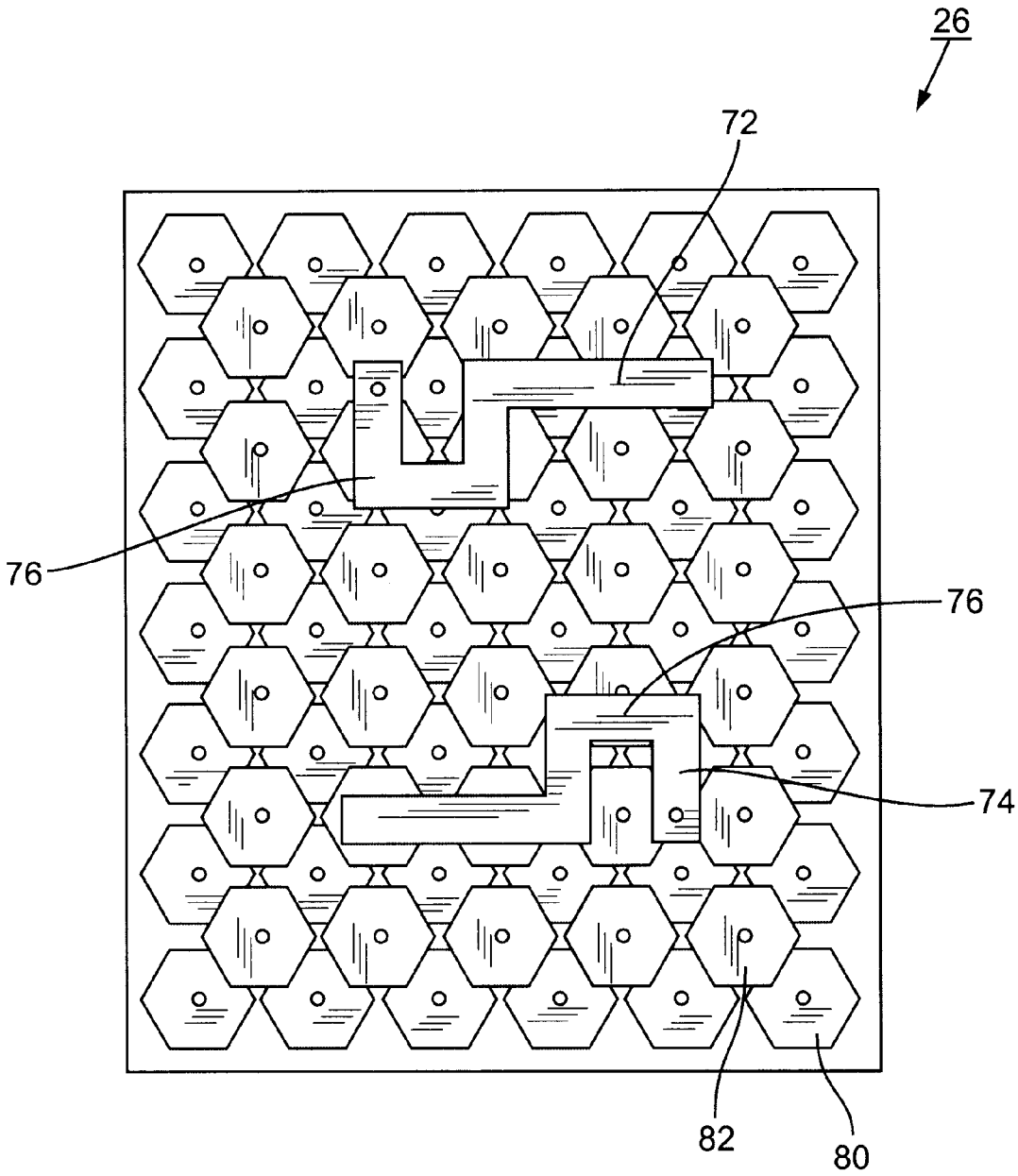
FIG. 7 illustrates a third alternate embodiment with hexagonal overlapping plates.

The two distinct levels of overlapping conductive plates 80, 82 are illustrated in FIG. 2 as octagons. Please note that other polygonal and irregular shapes are contemplated. Specifically, triangles, hexagons, squares and circles are also acceptable plate shapes (see FIGS. 5–7). The octagonal shapes illustrated do allow for spaces therebetween such that the through-hole via 90 may pass therethrough without intersecting either set of plates 80, 82. If the through-hole via 90 does pass through a plate 80, 82, clearances must be made so as to avoid a short circuit therebetween.

Collectively, the substrate structure 70 is well-suited for incorporation into a mobile terminal 20 in that a single modular substrate structure 70 may have a footprint not much larger than one and one half inches squared (3.81 cm×3.81 cm). The size of the radiating elements 72, 74 may be varied according to the desired operating frequencies.

This modular structure has the antenna 26, a ground plane, and as much of the transceiver circuitry as desired for easy incorporation into a mobile terminal 20.

Figure 4:
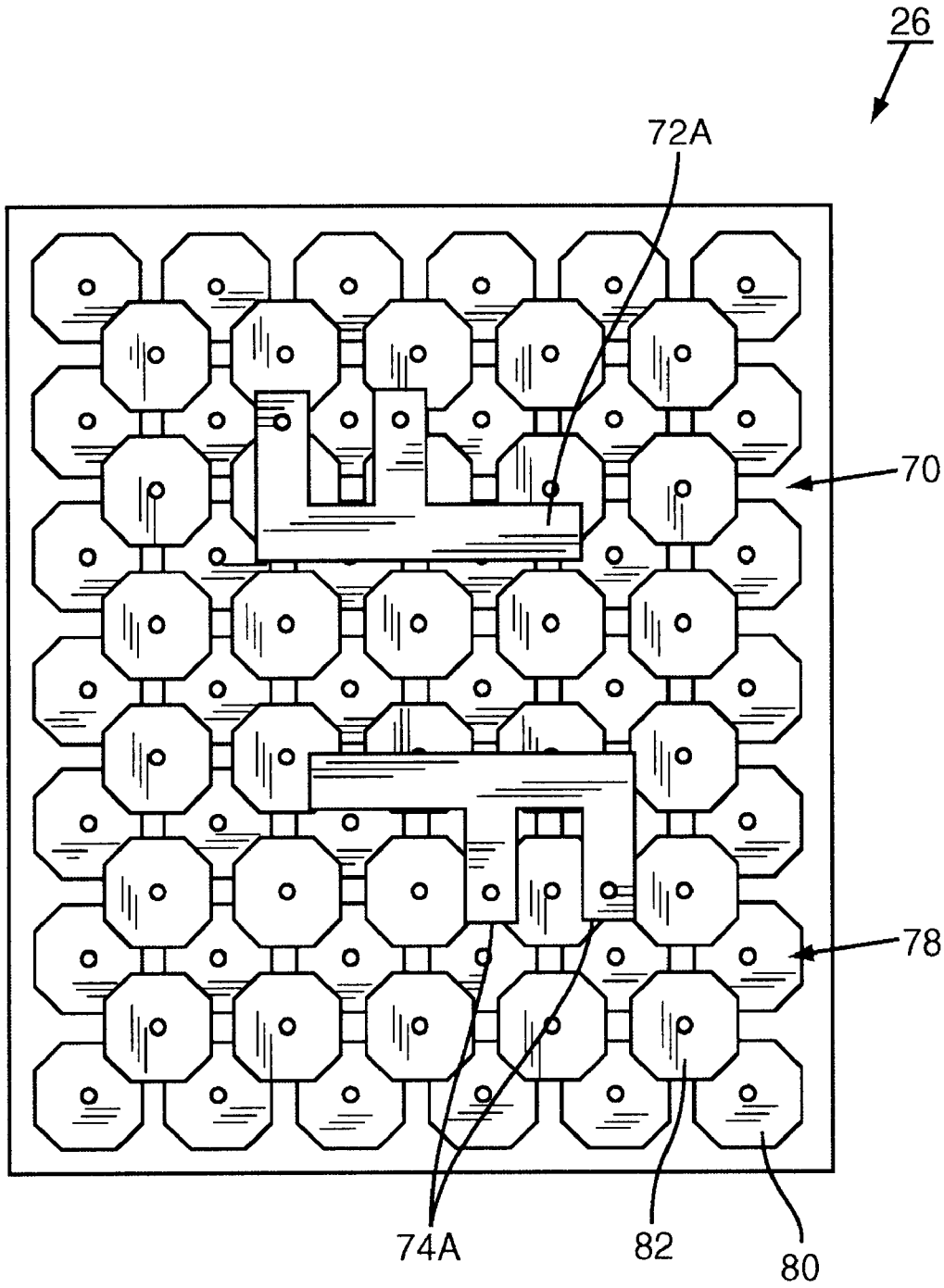
FIG. 4 illustrates a top plan view of a second embodiment of the antenna of the present invention.

While substantially similar to the radiating elements 72, 74, a second embodiment relies on inverted F radiating elements 72A, 74A as illustrated in FIG. 4. It should be appreciated that the placement of the radiating elements 72A, 74A relative to one another may be varied to provide for optimal matching and minimal crosstalk as needed or desired. For example, the radiating elements 72A, 74A might be rotated in the plane in which they lie so that the bars of the F both faced in, if desired. Other configurations are likewise within the scope of the present invention.

Those skilled in the art will recognize improvements and modifications to the preferred embodiments of the present invention. All such improvements and modifications are considered within the scope of the concepts disclosed herein and the claims that follow.

What is claimed is:

1. An antenna structure, comprising:

a substrate structure;

a radiating element;

a ground plane positioned proximate said radiating element and secured to a first side of said substrate structure, said ground plane comprising a bi-leveled sequence of staggered, overlapping conductive plates;

at least one RF circuit element secured to a second side of said substrate structure, opposite said first side; and said radiating element operatively connected to said RF circuit element.

2. The antenna structure of claim 1 wherein said at least one RF circuit element is selected from the group consisting of:

a power amplifier; a receiver; a transmitter; a duplexer; a frequency synthesizer; a baseband processor; and a modulator.

3. The antenna structure of claim 1 wherein said at least one RF circuit element is operatively connected to said radiating element with a via extending through the ground plane.

4. The antenna structure of claim 1 wherein said radiating element comprises a patch antenna.

5. The antenna structure of claim 4 wherein said patch antenna comprises a kink.

6. The antenna structure of claim 1 wherein said radiating element comprises an inverted F antenna.

7. A method of constructing an antenna structure, comprising:

forming a ground plane from a bi-leveled sequence of staggered, overlapping plates;

positioning a radiating element over the ground plane on one side of a substrate structure;

securing at least one RF circuit element to an opposite side of the substrate structure;

electrically connecting said radiating element to said at least one RF circuit element.

8. The method of claim 7 wherein electrically connecting said radiating element to said at least one RF circuit element comprises electrically connecting said radiating element to a power amplifier.

9. The method of claim 7 wherein positioning a radiating element over a ground plane comprises positioning a patch antenna over a ground plane.

10. The method of claim 9 wherein positioning a patch antenna over a ground plane comprises positioning a patch antenna with a kink over a ground plane.

11. The method of claim 7 wherein positioning a radiating element over a ground plane comprises positioning an inverted F antenna over a ground plane.

12. An antenna structure comprising:

a substrate structure comprising a first side and a second side;

a first ground plane comprising a plurality of staggered, overlapping plates positioned on two distinct levels, said first ground plane positioned on said first side;

a patch antenna comprising a kink positioned generally parallel to and over said first ground plane on said first side; and an RF circuit element secured to said second side and electrically connected to said patch antenna with a through-hole via.

13. The antenna structure of claim 12 wherein said overlapping plates comprise overlapping octagonal plates.

14. The antenna structure of claim 12 wherein said overlapping plates comprise overlapping triangular plates.

15. The antenna structure of claim 12 wherein said overlapping plates comprise overlapping hexagonal plates.

16. The antenna structure of claim 12 wherein said overlapping plates comprise overlapping square plates.

17. The antenna structure of claim 12 wherein said substrate structure comprises FR4.

18. The antenna structure of claim 12 wherein said substrate structure comprises a plurality of plies of dielectric material;

a first ply positioned between said two distinct levels of overlapping plates;

a second ply positioned between an upper of said two distinct levels of overlapping plates and said patch antenna; and a third ply positioned between a lower of said two distinct levels of overlapping plates and said RF circuit element.

19. An antenna structure comprising:

a substrate structure comprising a first side and a second side;

a first ground plane comprising a plurality of overlapping plates positioned on two distinct levels, said first ground plane positioned on said first side;

a patch antenna comprising a kink positioned generally parallel to and over said first ground plane on said first side;

an RF circuit element positioned on said second side and electrically connected to said patch antenna with a through-hole via; and a second ground plane positioned between said ground plane of overlapping plates and said RF circuit element.

20. An antenna structure comprising:

a substrate structure comprising a first side and a second side;

a first ground plane comprising a plurality of overlapping plates positioned on two distinct levels, said first ground plane secured to said first side;

an inverted F antenna positioned generally parallel to and over said first ground plane on said first side; and an RF circuit element secured to said second side and electrically connected to said inverted F antenna with a through-hole via, wherein the overlapping plates have spaces therebetween such that the through-hole via may pass therethrough without insecting either set of plates.

* * * * *